US010206840B2

(12) United States Patent
Wakabayashi et al.

(10) Patent No.: US 10,206,840 B2
(45) Date of Patent: Feb. 19, 2019

(54) INCUBATOR WITH BUFFER

(71) Applicant: ATOM MEDICAL CORPORATION, Tokyo (JP)

(72) Inventors: Keisuke Wakabayashi, Saitama (JP); Naoki Suzuki, Saitama (JP); Shinsuke Sakuma, Saitama (JP); Keisuke Takarada, Saitama (JP); Ichiro Matsubara, Tokyo (JP); Terumi Matsubara, Tokyo (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 167 days.

(21) Appl. No.: 15/374,039

(22) Filed: Dec. 9, 2016

(65) Prior Publication Data

US 2017/0165141 A1 Jun. 15, 2017

(30) Foreign Application Priority Data

Dec. 15, 2015 (JP) ..... 2015-244035

(51) Int. Cl.
*A61G 11/00* (2006.01)

(52) U.S. Cl.
CPC ..... *A61G 11/006* (2013.01); *A61G 11/00* (2013.01); *A61G 11/001* (2013.01)

(58) Field of Classification Search
CPC ..... A61G 11/006; A61G 11/001; A61G 11/00
USPC ..... 600/21–22; 601/24; 5/101–109
See application file for complete search history.

(56) References Cited

U.S. PATENT DOCUMENTS

| | | | | |
|---|---|---|---|---|
| 3,335,713 | A * | 8/1967 | Grosholz | A61G 11/00 600/22 |
| 5,244,452 | A | 9/1993 | Vaccaro et al. | |
| 6,013,022 | A * | 1/2000 | Jones | A61G 11/00 600/22 |
| 6,071,228 | A * | 6/2000 | Speraw | A61G 11/00 600/22 |
| 6,611,978 | B1 * | 9/2003 | Schmidt | A61G 11/00 5/603 |
| 6,659,935 | B2 * | 12/2003 | Costanzo | A61G 11/00 5/610 |
| 6,880,188 | B1 * | 4/2005 | Schmidt | A61B 6/4283 177/144 |
| 6,971,127 | B2 * | 12/2005 | Richards | A47D 9/02 5/108 |
| 2010/0113864 | A1 | 5/2010 | Matsubara et al. | |

(Continued)

FOREIGN PATENT DOCUMENTS

| | | |
|---|---|---|
| JP | 2002-153523 | 5/2002 |
| JP | 2010-99243 | 5/2010 |

(Continued)

OTHER PUBLICATIONS

Extended European Search Report dated Apr. 18, 2017 in corresponding European Application No. 16203644.6.

*Primary Examiner* — Navin Natnithithadha
*Assistant Examiner* — Sunita Reddy
(74) *Attorney, Agent, or Firm* — Wenderoth, Lind & Ponack, L.L.P.

(57) ABSTRACT

A bed is stably mounted on a body when located at a first position. The bed is mounted on the body via buffering members so that the buffering members absorb and prevent vibration and shock from being transmitted from the body to the bed, when located at the second position.

6 Claims, 5 Drawing Sheets

(56) References Cited

U.S. PATENT DOCUMENTS

| | | | | |
|---|---|---|---|---|
| 2015/0190296 | A1* | 7/2015 | Edavana | A61G 11/008 248/346.06 |
| 2015/0202104 | A1* | 7/2015 | Edavana | A61G 11/008 600/22 |

FOREIGN PATENT DOCUMENTS

| | | |
|---|---|---|
| JP | 2014-200494 | 10/2014 |
| WO | 2014/145253 | 9/2014 |

* cited by examiner

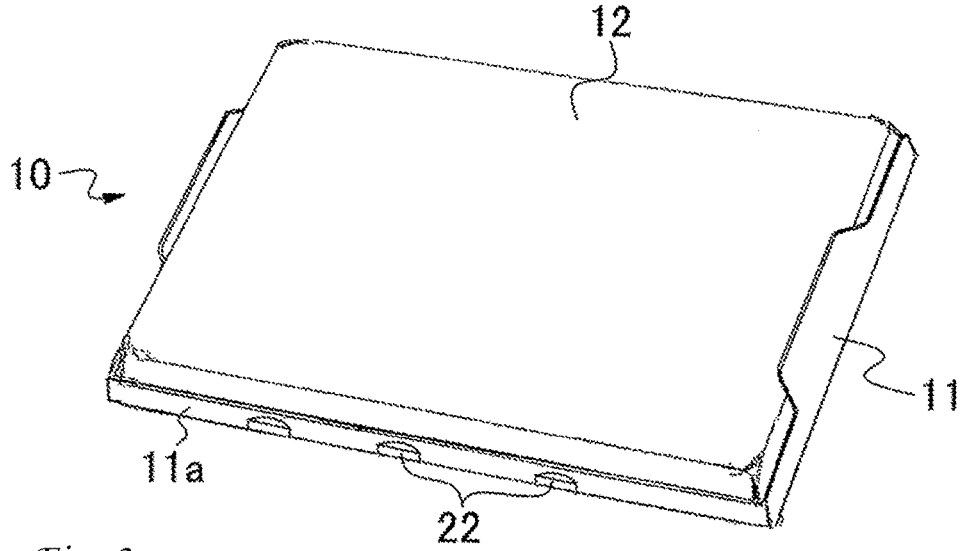
*Fig. 3*
*Fig. 4*
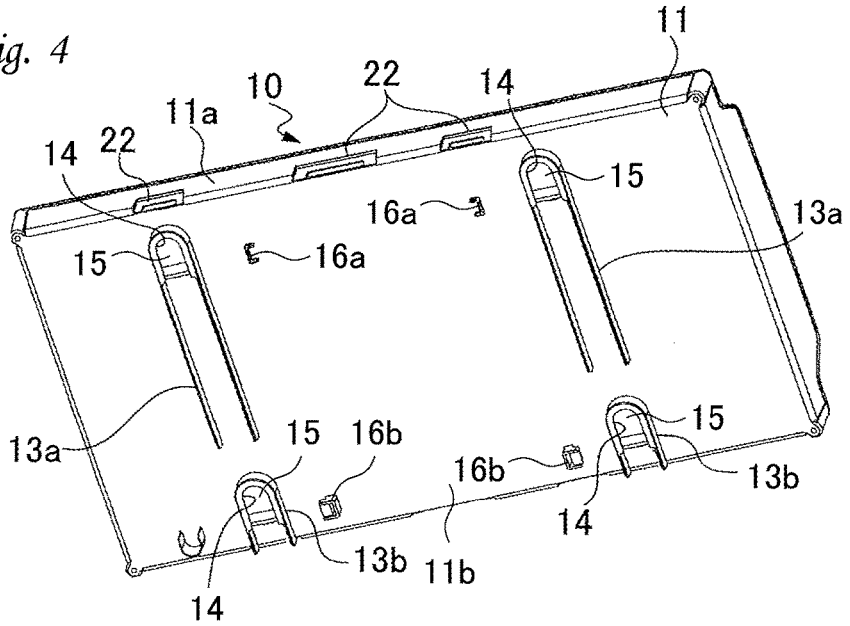

INCUBATOR WITH BUFFER

Priority is claimed on Japanese Patent Application No. 2015-244035, filed on Dec. 15, 2015, the content of which is incorporated herein by reference.

TECHNICAL FIELD

The present invention is related to an incubator.

BACKGROUND ART

It is known that an incubator for accommodating of a baby includes a bed for putting the baby on it. In order to ensure accuracy of treatment of the baby, the bed is securely fixed to a body of the incubator.

SUMMARY OF INVENTION

Problem to be Solved

When transferring the baby to another hospital or the like, it is difficult to transfer the baby remaining accommodated in the incubator. The reason is that the transferring may cause vibration and/or shock, which may result in discomfort and/or injury of the baby accommodated in the incubator.

The present invention aims to solve such problems.

Means to Solve

An incubator according to the present invention includes a body and a bed. The body includes a buffering member. The bed is movable between a first position and a second position. The bed is stably mounted on the body when located at the first position. The bed is mounted on the body via the buffering member so that the buffering member absorbs and prevents vibration and shock from transmitting from the body to the bed, when located at the second position.

The body may include an upper face. The buffering member may be fixed on the upper face. The upper face may include a supporting part protruding upward. The bed may be mounted on the supporting part when located at the first position. The bed may be mounted on the buffering member when located at the second position.

The bed may include a lower face. The lower face may include a hill part protruding downward. When the bed is located at the first position, the supporting part may contact with the lower face. When the bed is located at the second position, the buffering member may contact with the hill part and the supporting part may be apart from the lower face.

The lower face may include a sandwiching part facing the hill part. The buffering member may include an elastic material and an engaging part. The elastic material may be fixed on the upper face of the body. The engaging part may be fixed on the elastic material. When the bed is located at the second position, the engaging part may be held between the hill part and the sandwiching part.

The incubator may further include a hood covering the bed. The hood may be able to be opened and closed. When the hood is closed, the bed may be fixed at the second position. When the hood is opened, the bed may be allowed to move between the first position and the second position.

The bed may include a guiding part engaging with the buffering member. The guiding part may guide movement of the bed between the first position and the second position.

The bed may be removable. The guiding part may guide attachment and removal of the bed.

Advantageous Effects of Invention

When treating a baby put on the bed, one can locate the bed at the first position. This makes the bed stable, and thereby enables to ensure accuracy of the treatment.

When transferring the baby, one can locate the bed at the second position. This prevents transmission of vibration and shock to the bed, and thereby enables transferring while the baby remains put on the bed.

BRIEF DESCRIPTION OF DRAWINGS

Referring to the accompanying drawings, embodiments will be described in detail. The embodiments and the drawings are provided only for more complete understanding of the present invention. They are not intended to limit the present invention in any meanings.

FIGS. 3 and 4 are perspective views showing an example of a bed.

EMBODIMENTS

Figure 1:
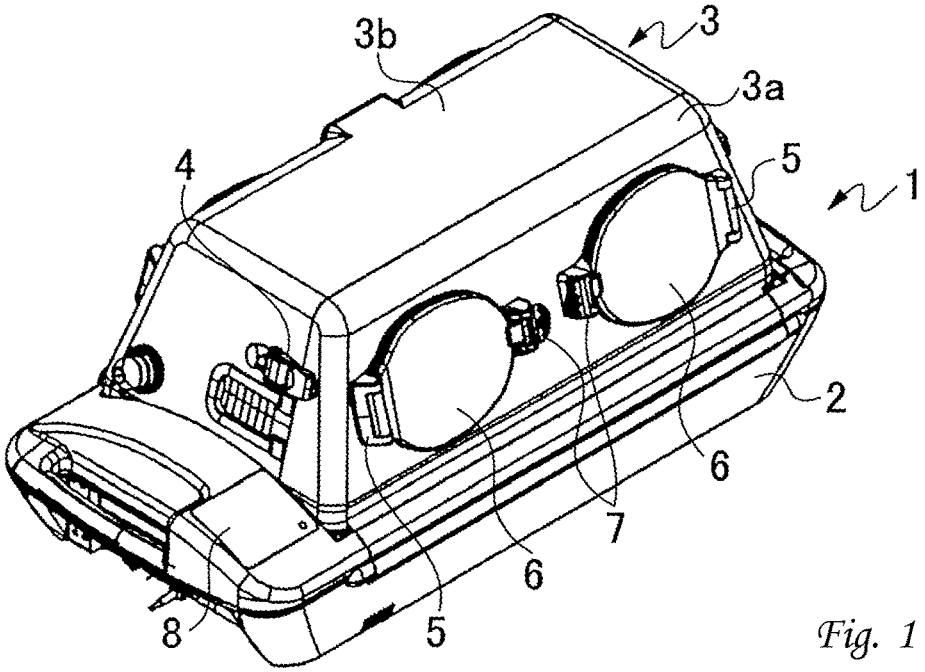
FIGS. 1 and 2 are a perspective view and a sectional side view showing an example of an incubator.

As shown in FIG. 1, an incubator 1 may include a body 2 and a hood 3. The incubator 1 may be used for nursing of a baby, such as a newborn baby or the like.

The hood 3 covers above the body 2, to define an accommodating space between the body 2 and the hood 3, which accommodates the baby. The hood 3 is made of synthetic resins or the like, and transparent so as to enable observation of the baby from outside.

The body 2 may include various equipment, not shown, such as an oxygen concentration adjuster, an temperature adjuster, or the like, to adjust environment in the accommodating space for the baby. The body 2 may include a console, or control board, 8 for control of the equipment. The body 2 may have batteries 23, shown in FIG. 2, in it such that the equipment can work while transferring.

Figure 5:
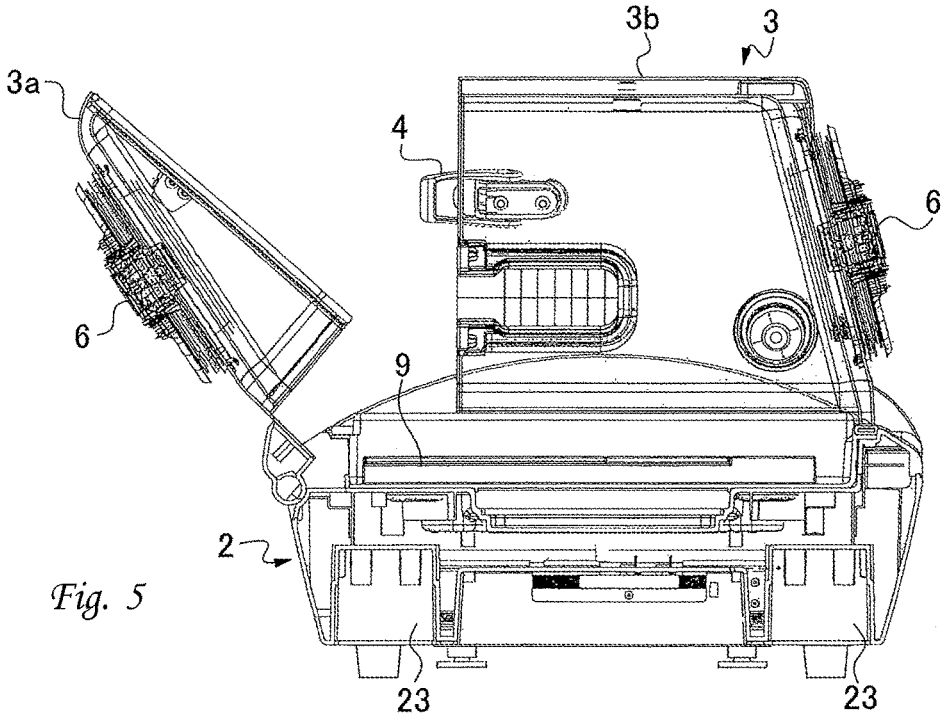
FIG. 5 is a sectional side view showing an example of a body and a hood.
Figure 8:
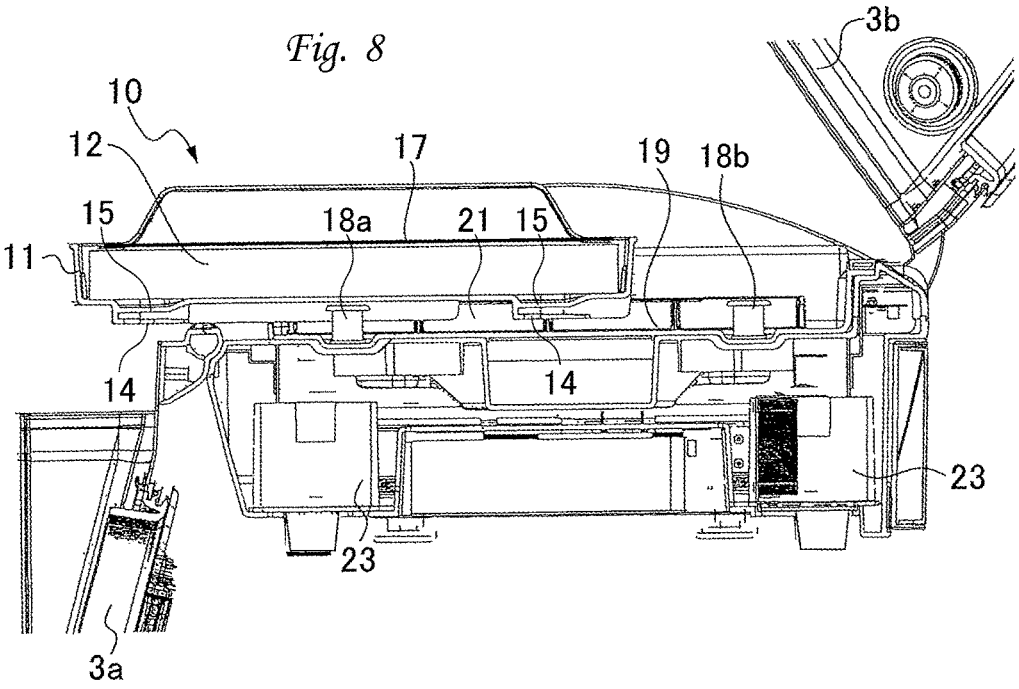
FIGS. 8 to 10 are enhanced sectional side views showing an example of the body and the bed.

The hood 3 may be openable. The hood 3 may be divided to a front hood 3*a* and a rear hood 3*b*. The front hood, or thin hood, 3*a* may mainly include a front side part of the hood 3, and be engaged to the body 2 by hinges or the like enabling forward rotation, as shown in FIG. 5, to open the accommodating space. The rear hood, or thick hood, 3*b* may mainly include left and right side parts, a rear side part, and an upper part, of the hood 3, and be engaged to the body 2 by hinges or the like enabling backward rotation, as shown in FIG. 8, to open the accommodating space. The hood 3 may include a clasp, or locking means, 4 for locking the front hood 3*a* and the rear hood 3*b* to inhibit them from being opened. The front hood 3*a* and the rear hood 3*b* may also be able to be removed from the body 2.

The hood 3 may also include windows for putting hands into the accommodating space to access the baby without opening the front hood 3*a* or the rear hood 3*b*. The hood 3 may include doors 6 for closing the windows. Each of the doors 6 may be able to be rotated around a shaft 5 to be opened outward, and able to be locked by a latch, or locking part, 7 to be prevented from being opened. Each of the front hood 3*a* and the rear hood 3*b* may be provided with two windows to enable two operators to put both their hands into the incubator 1 from the front side and the rear side.

Figure 2:
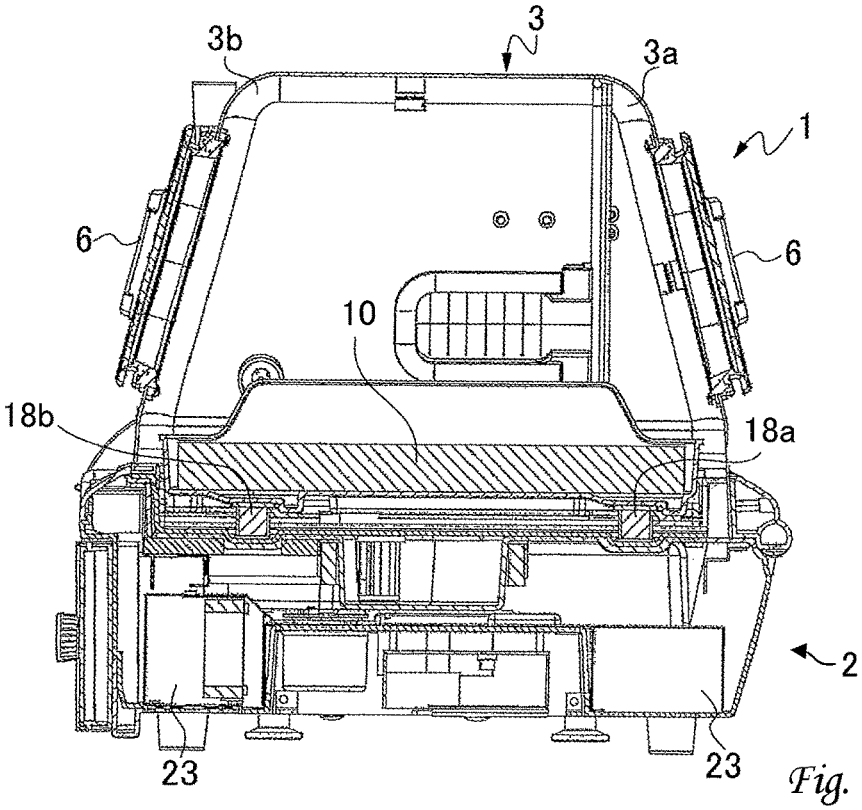

As shown in FIG. 2, the incubator 1 includes a bed 10, on which the baby is put. The bed 10 is mounted on the body 2, and accommodated in the accommodating space defined by the hood 3.

The body 2 includes buffering members 18*a* and 18*b*, which absorb, or buffer, vibration and/or shock. The bed 10 is mounted and held on buffering members, or insulators, 18*a* and 18*b*, which prevents vibration and/or shock from transmitting to the bed 10 when the incubator 1 is transferred.

As shown in FIG. 3, the bed 10 may include a tray 11 and a mattress 12. The tray 11 may have a rectangular shape, and may be made of metal, plastics or the like. The bed 10 may include seatbelt mounting parts 22 on a side face 11*a* of the tray 11. The seatbelt mounting parts 22 may include hook-and-loop fasteners for fixing a seatbelt to it. This enables to prevent movement of the baby while transferring. The baby may be covered with a soft towel or the like, and the seatbelt may be put on it. The mattress 12 may be covered with a bed sheet 17, shown in FIG. 8. The bed sheet 17 may be replaceable. Cushioning material, such as urethane sponge, cotton, rubber, packed gel, liquid or gas, or the like, may be laid on the mattress 12, and the baby may be put on it.

As shown in FIG. 4, the bed 10 may include guiding parts 13*a* and 13*b*, sandwiching parts 14, hill parts 15, and protrusions 16*a* and 16*b* under a lower face, or rear face, 11*b* of the tray 11. The guiding parts 13*a* and 13*b*, the hill parts 15, and the protrusions 16*a* and 16*b* may protrude downward from the lower face lib. The guiding parts, or guide rails, 13*a* and 13*b* may have a U-shape. The guiding parts 13*a* may be longer than the guiding parts 13*b*. The guiding parts 13*a* and 13*b* may be parallel to narrow sides of the tray 11.
The sandwiching parts, or flange, 14 may face the hill parts 15.

As shown in FIG. 5, the body 2 may include an upper face 9.

Figure 6:
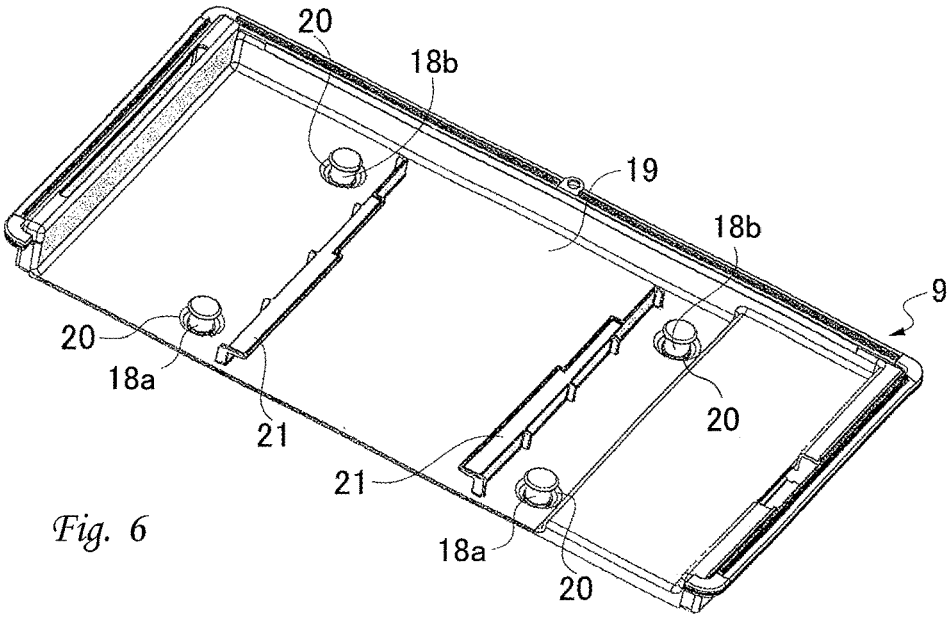
FIG. 6 is a perspective view showing an example of an upper face.

As shown in FIG. 6, the upper face 9 may include a top board 19 and supporting parts 21. The supporting parts, or top board rails, 21 may protrude upward from the top board 19. The top board 19 may include recesses 20.

The buffering members 18*a* and 18*b* may be securely fixed on the upper face 9, and may be disposed at vertices of a rectangle. Upper ends of the buffering members 18*a* and 18*b* may lower than upper ends of the supporting parts 21. Differences between the altitudes of the buffering members 18*a* and 18*b* and the supporting parts 21 may be smaller than heights of the hill parts, or step parts, 15. The buffering members 18*a* and 18*b* may be disposed in the recesses 20. This enables to increase heights of the buffering members 18*a* and 18*b*, and thereby to enhance buffering capacity.

Figure 7:
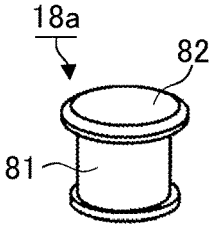
FIG. 7 is an enhanced perspective view showing an example of a buffering member.

As shown in FIG. 7, the buffering member 18*a* may include an elastic material 81 and an engaging part 82. The buffering member 18*b* is similar to the buffering member 18*a*. The elastic material 81 may have a roughly cylindrical shape perpendicular to the upper face 9, may be made of rubber, and may absorb vibration and shock. The engaging part, or slippery material, 82 may be a metal plate with a roughly disc shape or a roughly ring shape, and may be held between the sandwiching part 14 and the hill part 15. This enables to prevent bouncing and sliding of the bed 10 while transferring.

The bed 10 may be movable by sliding on the body 2. The guiding parts 13*a* and 13*b* may engage with the buffering member 18*a* and 18*b* to guide the sliding of the bed 10. The protrusions 16*a* and 16*b* may engage with the supporting parts 21 to aid the sliding of the bed 10.

When the hood 3 is closed as shown in FIG. 2, the bed 10 may be fixed to the body 2 via the buffering members 18*a* and 18*b* without ability of sliding,. This enables to prevent sliding of the bed 10 while transferring. The hood 3 may be provided with second buffering members, and the second buffering members may contact with the bed 10 to hold it when the hood 3 is closed.

When the hood 3 is opened as shown in FIG. 8, the bed 10 may be drawn out of the body 2 by sliding. The bed 10 may be further drawn out to allow removal from the body 2. When attaching the bed 10 to the body 2, one may firstly engage the guiding parts 13*a* with the buffering members 18*a*, then may push and slide the bed 10 on the supporting parts 21, and may finally engage the guiding parts 13*b* with the buffering members 18*b*.

Figure 9:
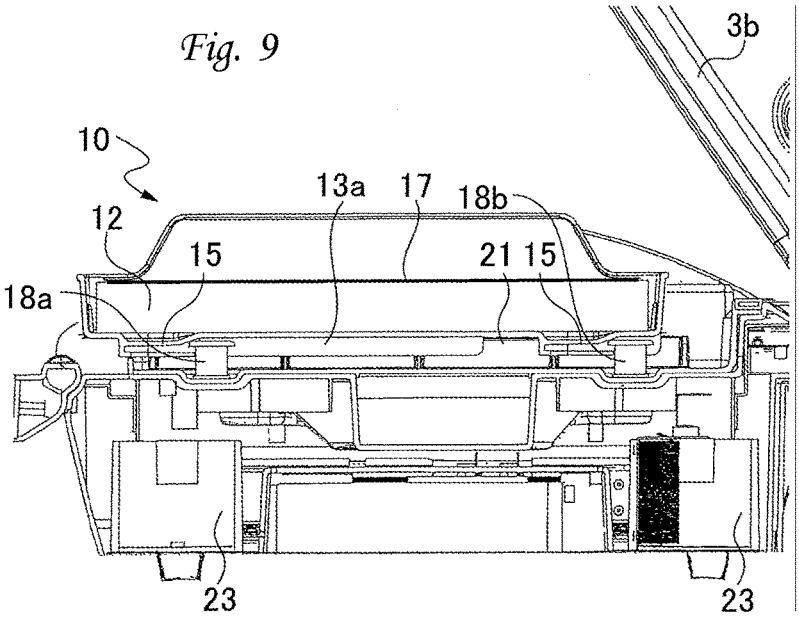

When treating the baby, or patient, put on the bed 10, one may slightly draw out the bed 10, as shown in FIG. 9, to locate it at a first position. If the upper ends of the supporting parts 21 are higher than the upper ends of the buffering members 18*a* and 18*b*, the supporting parts 21 contact with the lower face 11*b* and the buffering members 18*a* and 18*b* are apart from the lower face lib. This enables to securely support the bed 10, to prevent the bed 10 from leaning while treatment, and thereby to secure accuracy of the treatment. The buffering members 18*a* and 18*b* may contact with slopes of the hill parts 15.

Figure 10:
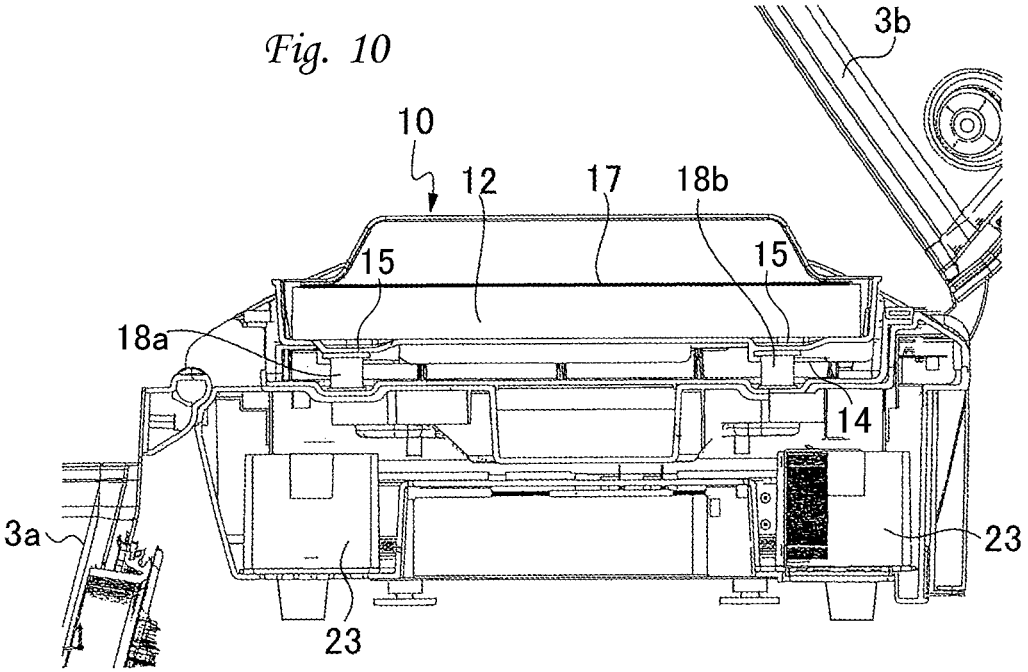

When transferring the baby put on the bed 10, one may push the bed 10 as far as it goes, as shown in FIG. 10, to locate it at a second position. If the engaging parts 82 is held between the sandwiching parts 14 and the hill parts 15, the bed 10 is fixed to the buffering members 18*a* and 18*b*. This enables to prevent bouncing and sliding of the bed 10 while transferring. If the heights of the hill parts 15 are larger than the differences between the supporting parts 21 and the buffering members 18*a* and 18*b*, the buffering members 18*a* and 18*b* contact with the hill parts 15 and the supporting parts 21 are apart from the lower face 11*b*. This enables to prevent transmission of vibration and shock from the body 2 to the bed 10 via the supporting parts 21 while transferring.

As described above, the buffering members absorbing vibration and/or shock enables the transfer of the baby while being put on the incubator. The incubator may be mounted on a cart or the like to transfer the baby in a hospital or the like, or may be mounted on an ambulance, a helicopter or the like to transfer the baby between hospitals or the like.

When treating the baby, sliding the bed enables the bed to stably mounted directly on the body without the buffering members intervening between them. This enables the prevention of quaking of the bed causing disturbance of the treatment.

Also, when transferring or treatment is not required, the incubator can be used as a general one.

The above described embodiments are examples to make it easier to understand the present invention. The present invention is not limited to the example, and includes any modified, altered, added, or removed variations, without departing from the scope of the claims attached herewith. This can be easily understood by persons skilled in the art.

REFERENCE SIGNS LIST

1: incubator; 2: body; 3: hood; 3*a*: front hood; 3*b*: rear hood; 4: clasp; 5: shaft; 6: door; 7: latch; 8: console; 9: upper face; 10: bed; 11: tray; 11*a*: side face; 11*b*: lower face; 12: mattress; 13*a* and 13*b*: guiding part; 14: sandwiching part; 15: hill part; 16*a* and 16*b*: protrusion; 17: bed sheet; 18*a* and 18*b*: buffering member; 81: elastic material; 82: engaging part; 19: top board; 20: recess; 21: supporting part; 22: seatbelt mounting part; and, 23: battery.

The invention claimed is:

1. An incubator comprising a body and a bed, wherein
the body includes:
an upper face having a supporting part protruding upward; and
a buffering member fixed to the upper face,
the bed includes a lower face having a hill part protruding downward,
the bed is movable between a first position and a second position,
at the first position, the supporting part contacts the lower face, the buffering member is apart from the lower face, and the bed is stably mounted on the body, and
at the second position, the buffering member contacts the hill part, the supporting part is apart from the lower face, and the bed is mounted on the body via the buffering member so that the buffering member absorbs and prevents vibration and shock from being transmitted from the body to the bed.

2. The incubator of claim 1, wherein
the lower face includes a flange facing the hill part,
the buffering member includes an elastic material and an engaging part,
the elastic material is fixed on the upper face of the body,
the engaging part is fixed on the elastic material, and
at the second position, the engaging part is held between the hill part and the flange.

3. The incubator of claim 1, further comprising a hood covering the bed, wherein
the hood is openable and closable,
while the hood is closed, the bed is fixed at the second position, and
while the hood is opened, the bed is allowed to move between the first position and the second position.

4. The incubator of claim 1, wherein
the bed includes a guiding part engaging with the buffering member, and
the guiding part guides movement of the bed between the first position and the second position.

5. The incubator of claim 4, wherein
the bed is removable, and
the guiding part guides attachment and removal of the bed.

6. The incubator of claim 1, wherein
the bed moves laterally between the first position and the second position.

* * * * *